US007735746B2

(12) United States Patent
Igwenezie

(10) Patent No.: US 7,735,746 B2
(45) Date of Patent: Jun. 15, 2010

(54) DEVICE FOR INSOLATED JOINT FOR JOINING RAILS

(76) Inventor: Jude Odihachukwunma Igwenezie, 2 Ravencroff Circle, Brampton (CA) LGZ4P3

( * ) Notice: Subject to any disclaimer, the term of this patent is extended or adjusted under 35 U.S.C. 154(b) by 0 days.

(21) Appl. No.: 12/256,469

(22) Filed: Oct. 22, 2008

(65) Prior Publication Data

US 2010/0096468 A1 Apr. 22, 2010

(51) Int. Cl.
*E01B 11/00* (2006.01)

(52) U.S. Cl. ..... 238/159; 238/243; 238/248

(58) Field of Classification Search ..... 238/159, 238/243, 248

See application file for complete search history.

(56) References Cited

U.S. PATENT DOCUMENTS

| | | | | | |
|---|---|---|---|---|---|
| 2,441,329 | A * | 5/1948 | Payne | 238/155 |
| 2,628,784 | A * | 2/1953 | Payne | 238/155 |
| 2,670,136 | A * | 2/1954 | Moses | 238/155 |
| 2,808,996 | A * | 10/1957 | Delfox | 238/208 |
| 3,416,728 | A * | 12/1968 | Hamilton, Jr. | 238/152 |
| 3,658,245 | A * | 4/1972 | Nelson | 238/151 |
| 3,698,634 | A * | 10/1972 | Hamilton, Jr. | 238/152 |
| 3,910,492 | A * | 10/1975 | Sinfield | 238/243 |
| 3,952,948 | A * | 4/1976 | Nelson et al. | 238/243 |
| 4,105,160 | A * | 8/1978 | Ramer | 238/167 |
| 4,378,909 | A * | 4/1983 | Oger | 238/244 |
| 4,466,570 | A * | 8/1984 | Howard | 238/153 |
| 4,485,967 | A * | 12/1984 | Edwards | 238/226 |
| 7,097,112 | B2 * | 8/2006 | Urmson et al. | 238/243 |
| 2006/0027674 | A1 * | 2/2006 | Urmson et al. | 238/243 |
| 2007/0034706 | A1 * | 2/2007 | Urmson et al. | 238/243 |
| 2008/0035749 | A1 * | 2/2008 | Igwenezie | 238/243 |
| 2009/0121037 | A1 * | 5/2009 | Urmson et al. | 238/243 |

FOREIGN PATENT DOCUMENTS

| | | | |
|---|---|---|---|
| EP | 268239 | A2 * | 5/1988 |

* cited by examiner

*Primary Examiner*—S. Joseph Morano
*Assistant Examiner*—Jason C Smith
(74) *Attorney, Agent, or Firm*—Furr Law Firm; Jeff Furr, Esq.

(57) ABSTRACT

The present invention is directed at an improved device for joining together abutting railway rails between two railway ties. The rails to be joined together have a head portion, a web portion and a toe portion. The saddle is split at the bottom and joined with the two bottom (lower) bolts. The saddle hugs the base of the rail at the joint preventing differential vertical (shearing) displacement of the two rail ends. This can be used in insulated and non-insulated joints. The bolts are isolated from the bars and saddle and directly contact the rail.

2 Claims, 8 Drawing Sheets

DEVICE FOR INSOLATED JOINT FOR JOINING RAILS

CROSS REFERENCE TO RELATED APPLICATION

None

TECHNICAL FIELD

The invention relates generally to devices for joining or splicing railroad rails.

BACKGROUND ART

Referring to FIG. 1, rail joints comprise of the two rails (1) connected together by a pair of joint (splice) bars (2) and a set of nuts (3) and bolts (4). Together they form the assembly shown in FIG. 1. Since their invention, rail joints have been a weakness in the railway track system. The joint is weaker than the rail section because the bending strength reflected by the section modulus of the two joint bars used at a joint is only a fraction (between twenty percent (20%) and fifty percent (50%)) of the section modulus of the rail section. The weaker joint section causes poor load distribution to the ties, excessive deflection of the rail and pumping of the track. To address this problem, railways worldwide adopted continuously welded rails, which in turn have their own set of problems. Unfortunately, we still need some joints in our system in order to separate the track into signal blocks. The signal bocks allow the train dispatcher to locate trains along the track. The signal blocks are also used for switching of the trains from one track to another and for rail break detection. For each signal block to work efficiently, the rails at adjacent blocks must be electrically isolated from one another.

Along came insulated joints (IJs) such as shown in FIG. 2. These joints have insulating materials (5) between the joint bars (6) and the rail (1) and between the bolts (4) and the rail (1) to ensure that, the two rails at the joint are electrically isolated from one another. Unfortunately, the insulator (5) is the Achilles heel of the IJ system. The polymer material cannot stand the contact and bending stresses from the passage of the train wheels. The problem is worsened by thermal stresses that arise from temperature swings. If the insulating material (5) is made from soft polymer such as rubber, it will cause the joint to flex excessively, loosen the bolts. The polymer will also ooze out at high temperatures. If the polymer is hard enough to maintain its molecular structure at high temperatures, it will be brittle in the winter months and unzip by brittle shear cracking. In either case, the strength of the joint and the excess displacement due to its geometry are not addressed.

In recent times, railways worldwide are pushing for Positive Train Control (PTC) systems that utilize Geo Positioning Satellites (GPS) to move trains. This will reduce the number of locomotive engineers required to operate a train. To ensure that switches are positively locked and lined up with the mainline requires that sturdier and better IJs be designed. Introduction of PTC in a dark territory will necessitate the use of IJs at all switches along the line for the same reason. This salient issue might surface in a few years reinforcing the fact that IJs are here to stay at least for the near term.

SUMMARY OF THE INVENTION

The present invention is directed at an improved device for joining together abutting railway rails between two railway ties. The rails to be joined together have a head portion, a web portion and a toe portion. The joining device is a saddle that includes first and second elongated metal joint bars for holding the abutting ends of the rails together. The present invention is directed at an improved device for joining together abutting railway rails between two railway ties. The rails to be joined together have a head portion, a web portion and a toe portion. The saddle is split at the bottom and joined with the two bottom (lower) bolts. The saddle hugs the base of the rail at the joint preventing differential vertical (shearing) displacement of the two rail ends. This can be used in insulated and non-insulated joints. The bolts are isolated from the bars and saddle and directly contact the rail.

BRIEF DESCRIPTION OF DRAWINGS

In the drawings, like characters of reference indicate corresponding parts in the different figures.

BEST MODE FOR CARRYING OUT THE INVENTION

Figures 1, 1A:
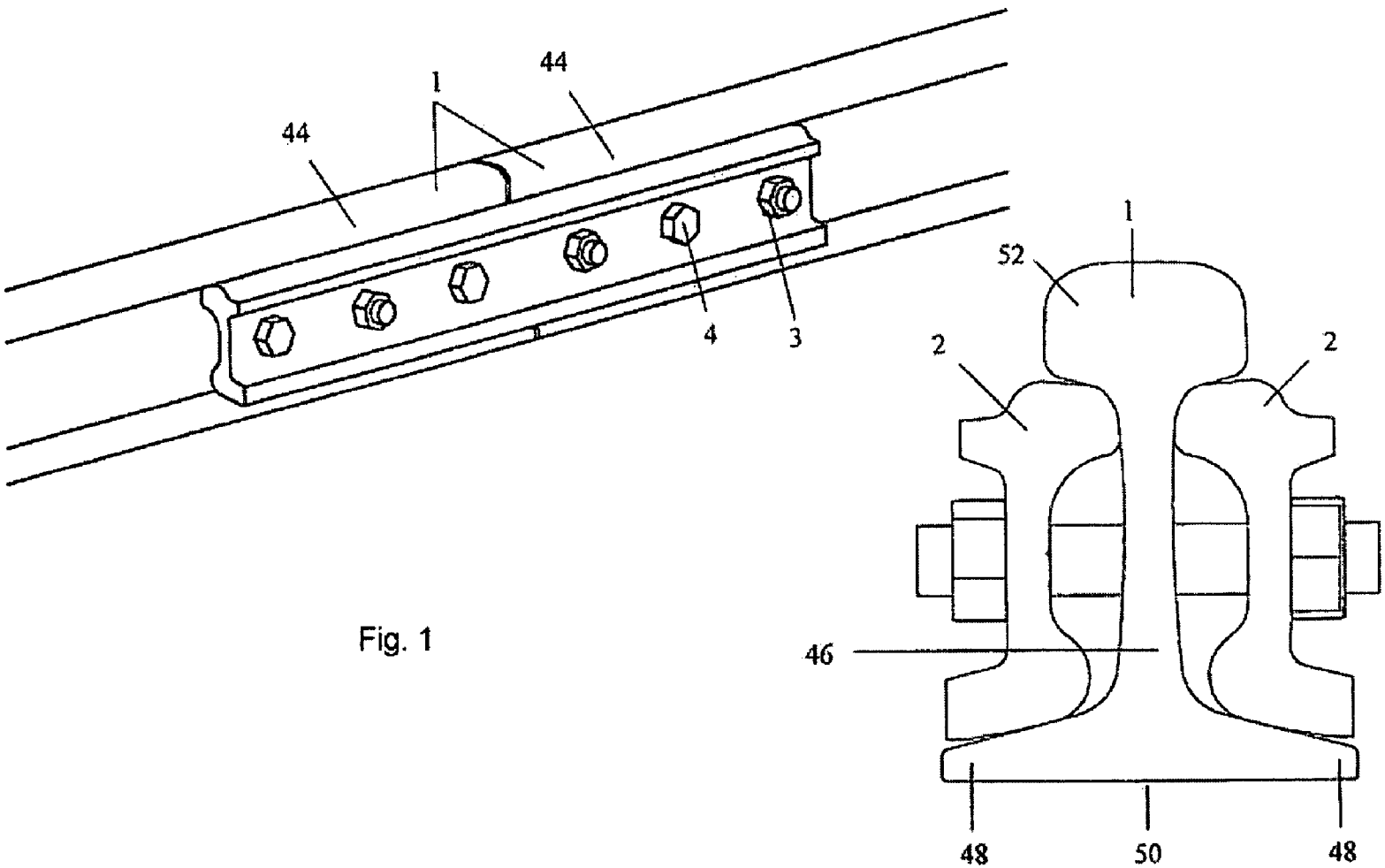
FIG. 1 is a perspective view of a prior art non-insulated joint system joining two rails.
FIG. 1*a* is a cross sectional view of the joint system shown in FIG. 1.
Figure 2A:
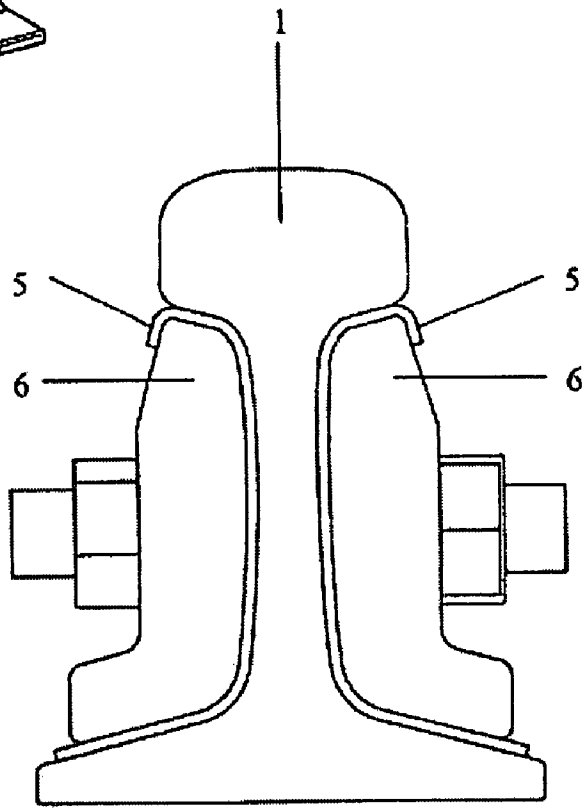
FIG. 2*a* is a cross sectional view of the joint system shown in FIG. 2.
Figure 2:
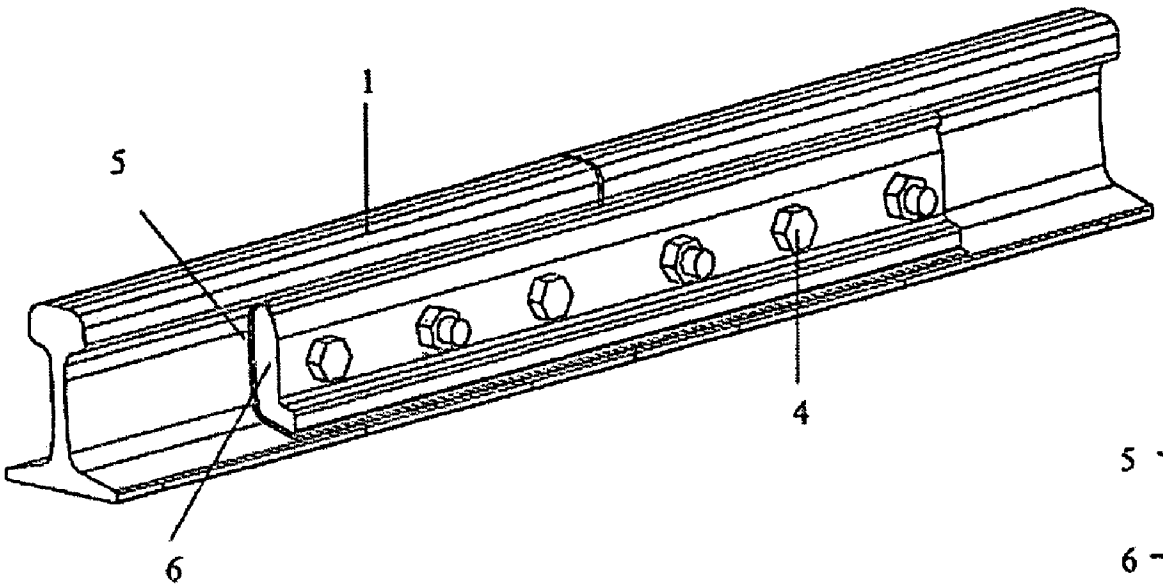
FIG. 2 is a perspective view of a prior art insulated joint system joining two rails.

Referring firstly to FIGS. 3*a* to 3*d* the present invention is directed at a joint assembly for joining rails 1 together in coaxial alignment at their abutting ends 44 between railway ties 25. Rails 1 each have head portion 52, web portion 46, toe portion 48 and bottom surface 50. This present invention provides a strengthen railway joint including two new joint bars (7), two insulators (8) between the rail (1) and the joint bars (7) and a saddle (9) that attaches to the joint assembly to increase the stiffness. Saddle 9 is comprised of two symmetric plates 60 and 62 having a head portion 56, a web portion 58 and a toe portion 54. The opposite lower ends of the saddle plates are notched to accommodate the ties.

As can be seen from the figures, joint bars 7 are attached to web portion 46 of rails 1 and span the joint between the two rails. Joint bars 7 are attached to the web on opposite sides of the web such that the web portion of the rails are sandwiched between the joint bars. The joint bars are dimensioned and configured to fit against the web portion 46 of the rails between toe portion 48 and head portion 44.

The saddle 9 is split at the bottom and joined with the two bottom (lower) bolts 70. The saddle hugs the base of the rail at the joint preventing differential vertical (shearing) displacement of the two rail ends. This can be used in insulated and non-insulated joints. The bolts are isolated from the bars and saddle and directly contact the rail.

Saddle 9 is dimensioned and configured such that parallel saddle plates 60 and 62 can be mounted to joint bars 7 such that the joint bars and the web of the rails are sandwiched between saddle plates 60 and 62. The lower edges 58 of parallel plates 60 and 62 extend below toe portion 48 of rails 1. Connector portion 60 joins lower edges 58 of parallel saddle plates 60 and 62 such that the saddle 9 forms a continuous U shaped bracket. Parallel saddle plates 60 and 62 have transverse portions extending transversely away from rail 1. The object of the saddle is to increase the stiffness of the joint and reduce the stresses in the insulating material by redistributing it to other parts of the joint system. The increased stiffness also means a reduction in the deflection of the joint. This reduces the pumping action at the joint. The increased stiffness is achieved in part by extending the lower edges of parallel plates 60 and 62 below toe portion 48 of the web. Transverse portions add additional transverse stiffness to the joint.

Figure 4A:
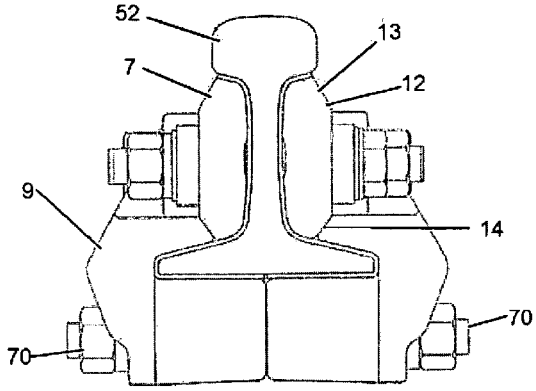
FIG. 4*a* is an end view of the embodiment shown in FIG. 3*a*.
Figure 4B:
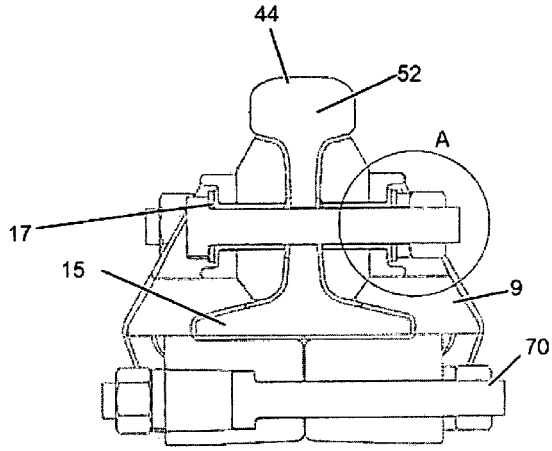
FIG. 4*b* is a cross-sectional view of the embodiment at the bolts shown in FIG. 3*a*.
Figure 4C:
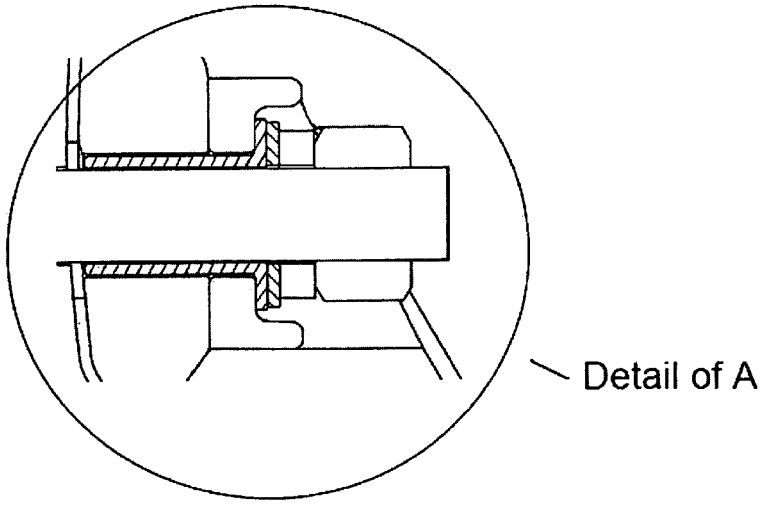
FIG. 4*c* is a zoomed in view of the embodiment at the bolts shown in FIG. 4*b*.
Figure 5:
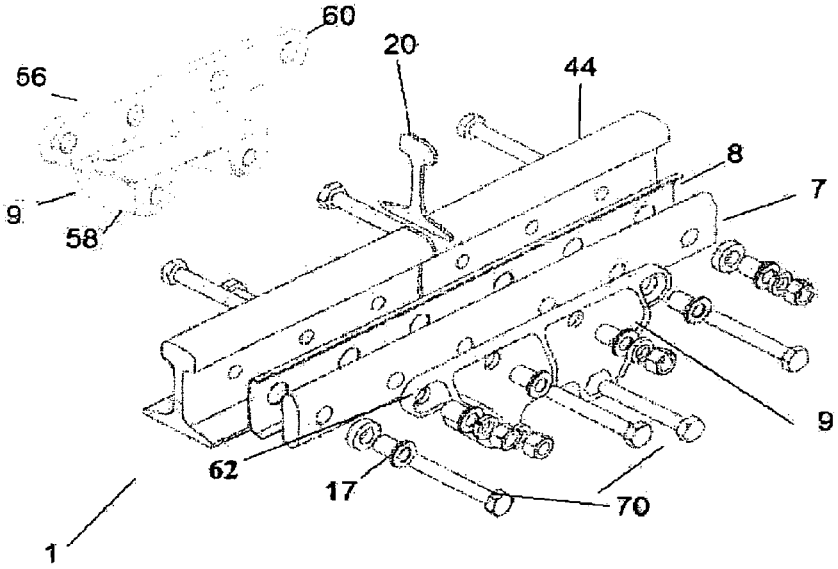
FIG. 5 is an exploded view of the invention shown in FIG. 3*a*.

A key element of the joint assembly design is the new joint bar (7). Looking at the transverse section of a joint (FIGS. 4*a* and 4*b*), it can be seen that the mid height (12) of the bar is substantially thicker than the top (13) and bottom (14). This is contrary to conventional joint bar designs where it is desirable to place more material at the upper and lower extremities of the joint bar for improved strength. The mid height (12) in the new joint bar is intentionally designed to protrude laterally such that when in an installed position, it extends laterally beyond the edges of the rail base. In addition to strengthening the joint, protrusion (12) of the joint bar (7) helps to ensure that when the saddle (9) is installed, the vertical walls will clear the edges of the rail based (15) to avoid short-circuiting the signals in the two rails. Referring now to FIG. 5, the bolts (4) are also electrically isolated from the rail (1) by means of cylindrical insulators (17) inserted into the bar 7 and saddle 9 of the rail. The bolts (4) then fit through the cylindrical insulators (17). Between the two rails is an end post (20) that prevents the ends of the rails from touching each other.

In a preferred embodiment, the saddle is two symmetric plates that connect together as shown in FIGS. 3*a*, 3*b*, 3*c* and 3*d*. From a side view of the assembly in FIG. 3*a*, it can be seen that the depth of the saddle (9) is least at the ends increasing towards the mid-span of the saddle. The intermediate portion of the saddle consists of two parallel plates with longitudinally arranged holes (23) made through them to accommodate the bolts (4) used to secure the joint. The bolts are isolated from the bars and saddle and directly contact the rail. The depth of the saddle walls contributes significantly to the vertical stiffness of the joint. The deeper the mid-span portions of the saddle, the stiffer the joint.

Figure 3A:
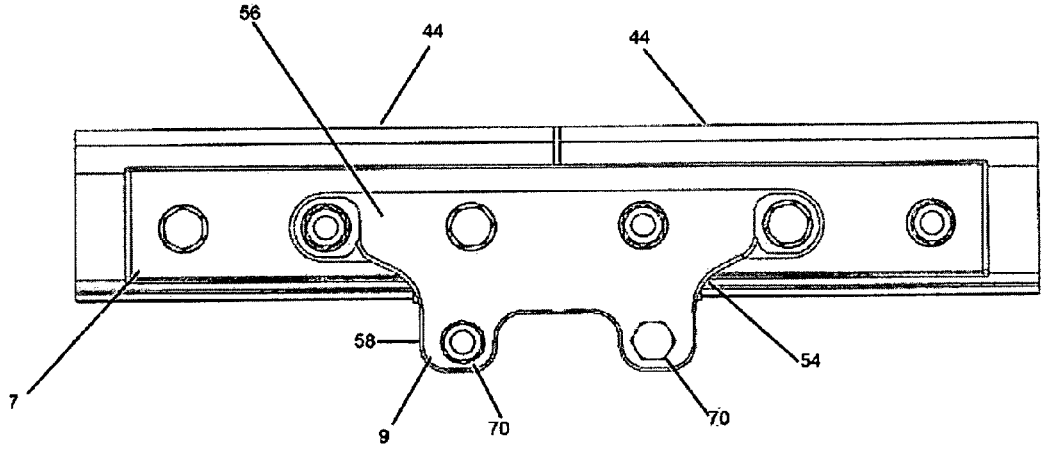
FIG. 3*a* is a side view of a joint system made in accordance with the present invention joining two rails.
Figure 3B:
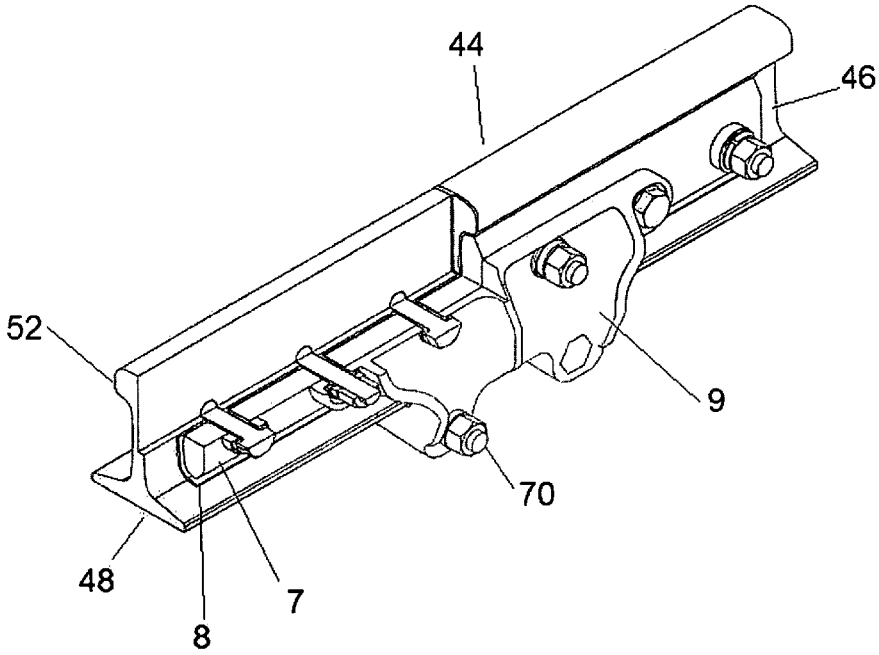
FIG. 3*b* is a perspective cut out view of the joint system shown in FIG. 3*a*.
Figure 3C:
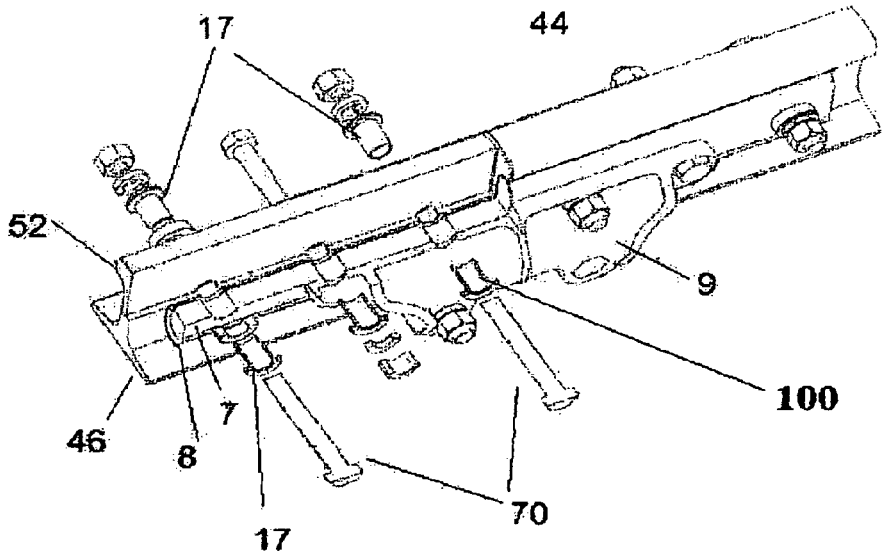
FIG. 3*c* is an exploded perspective view, partly in cross section, of the joint system shown in FIG. 3*b* with bolts being shown.
Figure 3D:
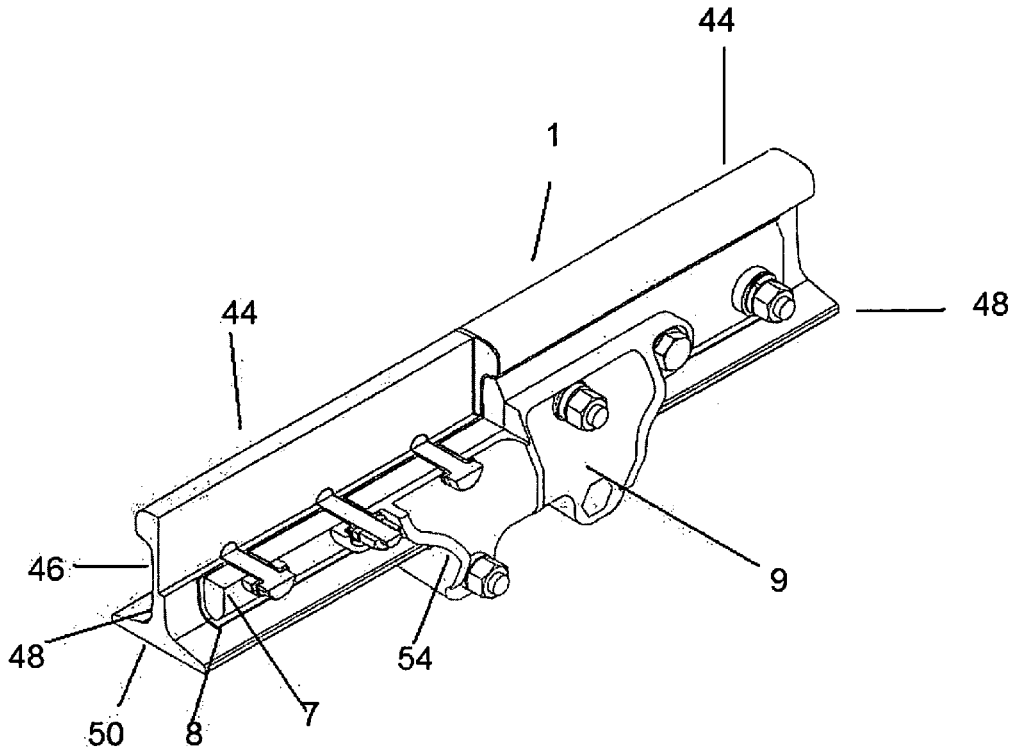
FIG. 3*d* is a perspective view of the joint system shown if FIG. 3*a*.

As shown in FIGS. 3*c* and 5, in the preferred embodiment the cylindrical insulator 17 are insulated thimble bushings which are used to protect the bolts (4) from touching the rail in an insulated joint. These thimble bushings generally consist of non-conductive polymer tube (100) that is inserted through the joint bars (7) and saddle (9) but not the rail as shown in FIG. 5. the insulated thimble bushings have a flatten bar ring at the end of the thimble.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

I claim:

1. A joint assembly for joining together abutting ends of two coaxially aligned rails (1) between two railway ties (25), the rails having a head portion (52), a web portion (46) and a toe portion (48), the assembly comprising: first and second elongated metal joint bars (7) for holding the abutting ends of the rails together, the joint bars spanning the ends of the rails, the joint bars being mounted to each rail on opposite sides of the web portions of each rail, the joint bars configured to mount to the web portions of the rail between the head and toe portion of each rail, first (60) and second (62) saddle plates connected together and mounted to the first and second joint bars, respectively, such that the joint bars and the web portion of the rails are sandwiched between the saddle plates, the saddle plates each having a top edge (56), a bottom portion (58) and opposite lower ends (54), with each of the saddle plates spanning the abutting ends of the rail, the bottom portion of the saddle plates extending below the toe portion of the rails, the opposite lower ends of the saddle plates being notched to accommodate the ties having the web portion and the joint bars having a plurality coaxially aligned apertures for receiving a thimble bushing which runs through the bar end the saddle but not through the rail where a bolt runs through insulated thimble bushings which are used to protect the bolts (4) from touching the rail in an insulated joint where said thimble bushings consist of non-conductive polymer tube (100) that is inserted through the joint bars (7) and saddle (9) but not the rail where said insulated thimble bushings have a flattened bar ring at the end of the thimble.

2. The joint assembly of claim 1 wherein a portion of the lower edges of the saddle plates extend perpendicularly towards and below the rails.

* * * * *